US011821193B2

(12) United States Patent
Nagata et al.

(10) Patent No.: US 11,821,193 B2
(45) Date of Patent: Nov. 21, 2023

(54) SANITARY WASHING DEVICE

(71) Applicant: TOTO LTD., Kitakyushu (JP)

(72) Inventors: Katsuya Nagata, Kitakyushu (JP); Yuki Ko, Kitakyushu (JP); Junki Hamada, Kitakyushu (JP)

(73) Assignee: TOTO LTD., Fukuoka (JP)

( * ) Notice: Subject to any disclaimer, the term of this patent is extended or adjusted under 35 U.S.C. 154(b) by 0 days.

(21) Appl. No.: 17/804,899

(22) Filed: Jun. 1, 2022

(65) Prior Publication Data

US 2022/0396944 A1 Dec. 15, 2022

(30) Foreign Application Priority Data

Jun. 14, 2021 (JP) ..... 2021-098644

(51) Int. Cl.
*E03D 9/08* (2006.01)

(52) U.S. Cl.
CPC ..... *E03D 9/08* (2013.01)

(58) Field of Classification Search
CPC ..... E03E 9/08; E03D 9/08
USPC ..... 4/420.4, 447–448, 420, 420.5
See application file for complete search history.

(56) References Cited

U.S. PATENT DOCUMENTS

2019/0368181 A1* 12/2019 Yaoka ..... A61L 2/10
2020/0056358 A1* 2/2020 Ko ..... B05B 15/555
2020/0392713 A1* 12/2020 Ko ..... B05B 15/70
2020/0392714 A1* 12/2020 Ko ..... E03D 9/08
2021/0164212 A1* 6/2021 Baba ..... A61L 2/084

FOREIGN PATENT DOCUMENTS

| | | | | |
|---|---|---|---|---|
| CN | 110965617 | A | 4/2020 | |
| DE | 102011086263 | A1 * | 5/2012 | E03D 9/08 |
| DE | 102016121761 | A1 * | 5/2017 | E03D 9/08 |
| EP | 1988225 | A1 * | 11/2008 | E03D 9/08 |
| EP | 3575503 | A1 * | 12/2019 | A47K 7/08 |
| JP | 2012-219482 | A | 11/2012 | |
| JP | 2017095921 | A * | 6/2017 | E03D 9/08 |
| JP | 6191226 | B2 | 9/2017 | |
| JP | 6741219 | B1 * | 8/2020 | B05B 1/20 |
| JP | 6765644 | B1 * | 10/2020 | B05B 1/20 |
| WO | WO-2007091691 | A1 * | 8/2007 | E03D 9/08 |
| WO | WO-2014136371 | A1 * | 9/2014 | E03D 9/08 |

* cited by examiner

*Primary Examiner* — Lori L Baker
(74) *Attorney, Agent, or Firm* — PEARNE & GORDON LLP

(57) ABSTRACT

A sanitary washing device includes a casing, a nozzle, and a nozzle drive unit. The nozzle drive unit advances and retracts the nozzle between a storage position and an advanced position. The nozzle drive unit includes a supporter, a gear, and a cable rack. The supporter includes a rail allowing the nozzle to slide. The gear applies a drive force to advance and retract the nozzle. The cable rack is connected with the nozzle and meshes with the gear. The cable rack includes a nozzle connection part connected with the nozzle. The gear and the cable rack mesh at a meshing part. The meshing part is positioned at a same position in a longitudinal direction as the nozzle connection part or further frontward than the nozzle connection part when the nozzle is at the storage position.

5 Claims, 11 Drawing Sheets

SANITARY WASHING DEVICE

CROSS-REFERENCE TO RELATED APPLICATIONS

This application is based upon and claims the benefit of priority from Japanese Patent Application No. 2021-098644, filed on Jun. 14, 2021; the entire contents of which are incorporated herein by reference.

FIELD

Embodiments described herein relate generally to a sanitary washing device.

BACKGROUND

In a known human body private part washing device that includes a nozzle washing a human body private part, the nozzle is advanced and retracted by a rack and a gear (e.g., JP-B 6191226). In such a human body private part washing device, the advance/retract operation of the nozzle undesirably becomes unstable if the sliding resistance is large when the nozzle is advanced and retracted.

SUMMARY

According to the embodiment, a sanitary washing device includes a casing, a nozzle, and a nozzle drive unit. The nozzle washes a human body private part. The nozzle drive unit advances and retracts the nozzle between a storage position and an advanced position. The nozzle is stored in the casing at the storage position. The nozzle is advanced from the casing at the advanced position. The nozzle drive unit includes a supporter, a gear, and a cable rack. The supporter supports the nozzle. The supporter includes a rail allowing the nozzle to slide. The gear applies a drive force to advance and retract the nozzle. The cable rack is connected with the nozzle and meshes with the gear. The cable rack includes a nozzle connection part connected with the nozzle. The gear and the cable rack mesh at a meshing part. The meshing part is positioned at a same position in a longitudinal direction as the nozzle connection part or further frontward than the nozzle connection part when the nozzle is at the storage position.

DETAILED DESCRIPTION

Figure 1:
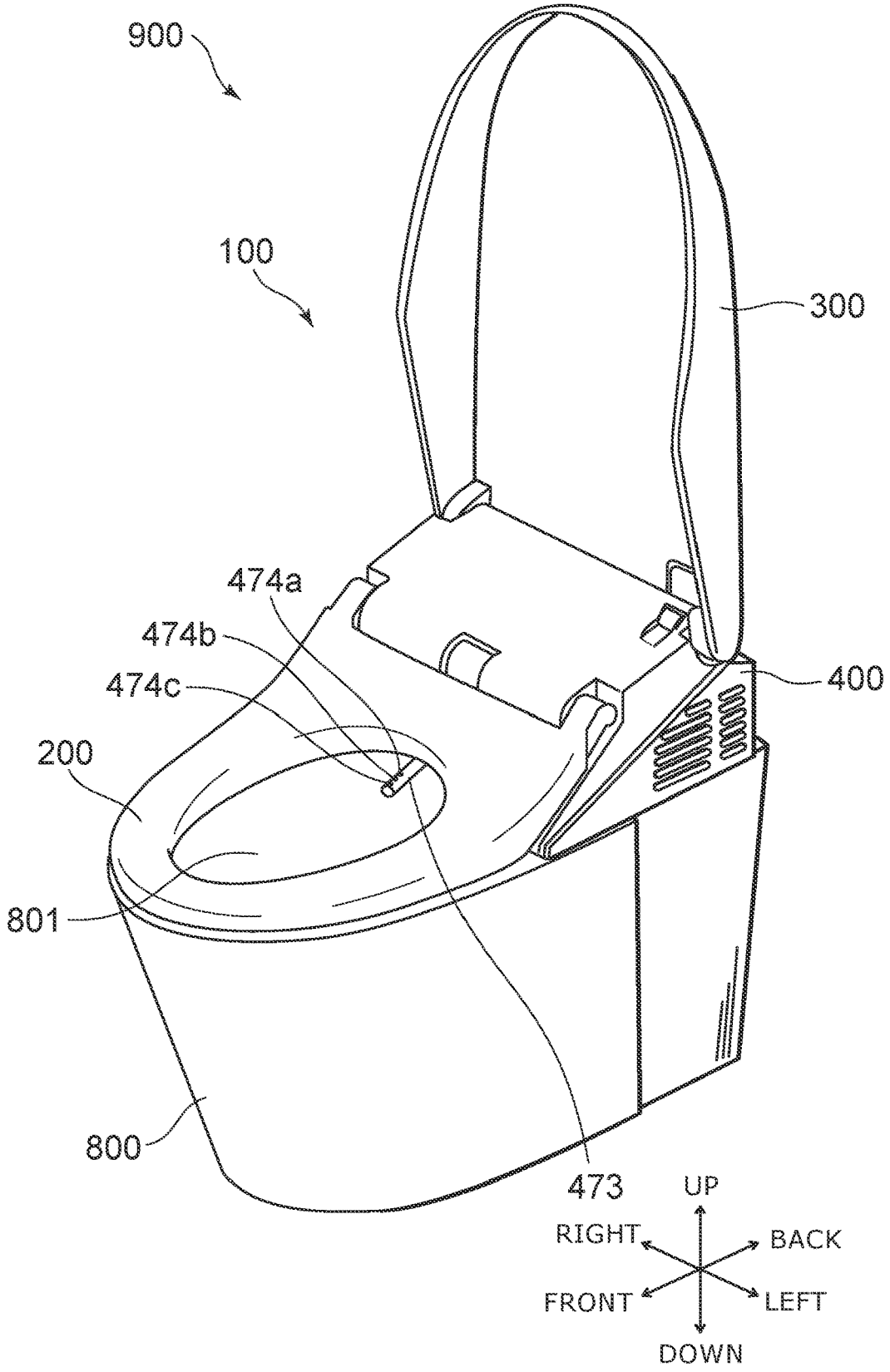
FIG. 1 is a perspective view illustrating a toilet device including a sanitary washing device according to an embodiment.

A first invention is a sanitary washing device that includes a casing, a nozzle washing a human body private part, and a nozzle drive unit advancing and retracting the nozzle between a storage position and an advanced position, wherein the nozzle is stored in the casing at the storage position, the nozzle is advanced from the casing at the advanced position, the nozzle drive unit includes a supporter, a gear, and a cable rack, the supporter supports the nozzle and includes a rail allowing the nozzle to slide, the gear applies a drive force to advance and retract the nozzle, the cable rack is connected with the nozzle and meshes with the gear, the cable rack includes a nozzle connection part connected with the nozzle, the gear and the cable rack mesh at a meshing part, and the meshing part is positioned at a same position in a longitudinal direction as the nozzle connection part or further frontward than the nozzle connection part when the nozzle is at the storage position.

According to the sanitary washing device, because the meshing part is positioned at the nozzle connection part and the same position in the longitudinal direction or further frontward than the nozzle connection part when the nozzle is at the storage position, the length of the part of the cable rack positioned further frontward than the meshing part can be less than in the case where the meshing part is positioned further backward than the nozzle connection part. The sliding resistance that is generated by the contact between the cable rack and the supporter when advancing and retracting the nozzle can be reduced thereby, and the advance/retract operation of the nozzle can be stabilized. Also, the motor that advances and retracts the nozzle can be downsized because the sliding resistance can be reduced. The nozzle drive unit can be downsized because the total length of the cable rack is shorter.

A second invention is the sanitary washing device of the first invention, wherein the meshing part is positioned further backward than a front end of the cable rack when the nozzle is at the storage position.

According to the sanitary washing device, the gear and the cable rack can be more reliably meshed because the meshing part is positioned further backward than the front end of the cable rack when the nozzle is at the storage position.

A third invention is the sanitary washing device of the second invention, wherein the meshing part is positioned within four teeth from the front end of the cable rack when the nozzle is at the storage position.

According to the sanitary washing device, because the meshing part is positioned within four teeth from the front end of the cable rack when the nozzle is at the storage position, the gear and the cable rack can be more reliably meshed, and exposure of the cable rack outside the casing when the nozzle is at the advanced position can be suppressed.

A fourth invention is the sanitary washing device of any one of the first to third inventions, wherein a center axis of the gear is positioned lower than the meshing part.

According to the sanitary washing device, because the center axis of the gear is positioned lower than the meshing part, the height of the nozzle drive unit can be less than in the case where the center axis of the gear is positioned higher than the meshing part.

A fifth invention is the sanitary washing device of any one of the first to fourth inventions, wherein the nozzle connection part is connected to a side surface of the nozzle.

According to the sanitary washing device, the space below the nozzle can be effectively used because the nozzle connection part is connected to the side surface of the nozzle. The distance between the motor and the nozzle can be reduced. The height of the sanitary washing device can be reduced thereby.

Exemplary embodiments will now be described with reference to the drawings. Similar components in the drawings are marked with the same reference numerals; and a detailed description is omitted as appropriate.

FIG. 1 is a perspective view illustrating a toilet device including a sanitary washing device according to an embodiment.

As illustrated in FIG. 1, the toilet device 900 includes a sit-down flush toilet (a toilet) 800 and the sanitary washing device 100 mounted on the sit-down flush toilet 800. The sanitary washing device 100 includes a casing 400, a toilet seat 200, and a toilet lid 300. The toilet seat 200 and the toilet lid 300 each are pivotally supported to be openable and closable with respect to the casing 400. The toilet 800 includes a bowl 801.

Although "up", "down", "front", "back", "right", and "left" are used in the description of embodiments described below, these are directions when viewed by a user sitting on the toilet seat 200 with the open toilet lid 300 at the back of the user as illustrated in FIG. 1.

A private part washing functional unit that realizes the washing of a private part such as a "bottom" or the like of the user sitting on the toilet seat 200, etc., are included inside the casing 400. The private part washing functional unit includes a nozzle 473. The nozzle 473 is advanceable and retractable between a storage position at which the nozzle 473 is stored in the casing 400, and an advanced position at which the nozzle 473 is advanced from the casing 400. The nozzle 473 advances along a linear trajectory toward the center of the bowl 801 positioned frontward and downward of the casing 400, and retracts along the linear trajectory into the casing 400 positioned backward and upward of the bowl 801. The state in which the nozzle 473 is at the advanced position is illustrated in the sanitary washing device 100 illustrated in FIG. 1.

A seating detection sensor 404 that detects the seating of the user on the toilet seat 200 (see FIG. 2) is included in the sanitary washing device 100. When the seating detection sensor 404 detects the user sitting on the toilet seat 200, for example, the user can advance the nozzle 473 to the advanced position and retract the nozzle 473 to the storage position by operating an operation part 500 such as a remote control, etc. (see FIG. 2).

The nozzle 473 washes the human body private part by discharging water (wash water) toward the human body private part in the state of being advanced from the casing 400. A bottom wash water discharge port 474*a*, a gentle wash water discharge port 474*b*, and a bidet wash water discharge port 474*c* are provided in the tip portion of the nozzle 473. The nozzle 473 can wash the "bottom" of the user sitting on the toilet seat 200 by squirting water from the bottom wash water discharge port 474*a* or the gentle wash water discharge port 474*b* provided in the tip. Or, the nozzle 473 can wash a female private part of a female sitting on the toilet seat 200 by squirting water from the bidet wash water discharge port 474*c* provided in the tip. In this specification, "water" includes not only cold water but also warm water that is heated.

The modes of washing the "bottom" include, for example, a "bottom wash" and a "gentle wash" that gently washes using a water stream that is softer than that of the "bottom wash". For example, the nozzle 473 can perform the "bottom wash", the "gentle wash", and the "bidet wash".

In the nozzle 473 illustrated in FIG. 1, the bidet wash water discharge port 474*c* is located further toward the distal side of the nozzle 473 than the gentle wash water discharge port 474*b*; and the gentle wash water discharge port 474*b* is located further toward the distal side of the nozzle 473 than the bottom wash water discharge port 474*a*; however, the placement positions of the bottom wash water discharge port 474*a*, the gentle wash water discharge port 474*b*, and the bidet wash water discharge port 474*c* are not limited thereto. Although three water discharge ports are provided in the nozzle 473 illustrated in FIG. 1, for example, the gentle wash water discharge port 474*b* may be omitted, or four or more water discharge ports may be provided.

Figure 2:
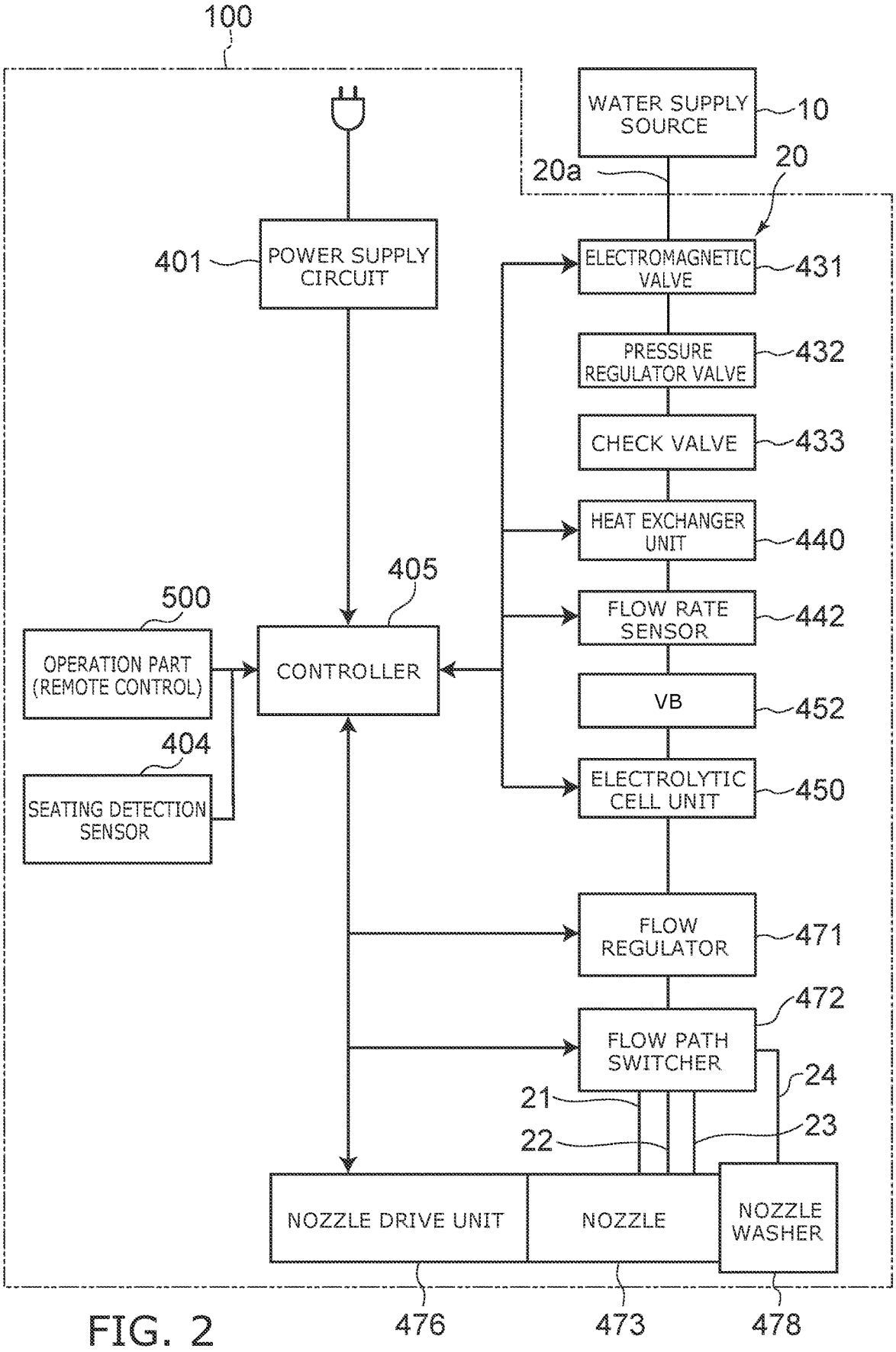
FIG. 2 is a block diagram schematically illustrating the relevant components of the sanitary washing device according to the embodiment.

FIG. 2 is a block diagram schematically illustrating the relevant components of the sanitary washing device according to the embodiment.

The relevant components of the water channel system and the electrical system are illustrated together in FIG. 2.

As illustrated in FIG. 2, the sanitary washing device 100 includes a water transfer part 20. The water transfer part 20 includes a pipe line 20*a* that reaches the nozzle 473 from a water supply source 10 such as a service water line, a water storage tank, etc. The water transfer part 20 guides the water supplied from the water supply source 10 to the nozzle 473 via the pipe line 20*a*. For example, the pipe line 20*a* is formed of parts such as an electromagnetic valve 431, a heat exchanger unit 440, a flow path switcher 472, etc., described below and multiple piping that connects these parts.

The electromagnetic valve 431 is located at the upstream side of the water transfer part 20. The electromagnetic valve 431 is an openable and closable electromagnetic valve and controls the supply of the water based on a command from a controller 405 located inside the casing 400. In other words, the electromagnetic valve 431 opens and closes the pipe line 20*a*. The water that is supplied from the water supply source 10 is caused to flow in the pipe line 20*a* by setting the electromagnetic valve 431 to the open state.

A pressure regulator valve 432 is located downstream of the electromagnetic valve 431. The pressure regulator valve 432 regulates the pressure inside the pipe line 20*a* to be within a prescribed pressure range when the water supply pressure is high. A check valve 433 is located downstream of the pressure regulator valve 432. The check valve 433 suppresses backflow of water toward the upstream side of the check valve 433 when the pressure inside the pipe line 20*a* decreases, etc.

The heat exchanger unit 440 (the heater) is located downstream of the check valve 433. The heat exchanger unit 440 includes a heater and heats the water supplied from the water supply source 10 to, for example, a specified temperature. In other words, the heat exchanger unit 440 produces warm water.

The heat exchanger unit 440 is, for example, an instant heating-type (instantaneous-type) heat exchanger using a ceramic heater, etc. Compared to a warm water storage heating-type heat exchanger that uses a warm water storage tank, the instant heating-type heat exchanger can heat water to a specified temperature in a short period of time. The heat exchanger unit 440 is not limited to an instant heating-type heat exchanger and may be a warm water storage heating-type heat exchanger. The heater is not limited to a heat exchanger; for example, another heating technique such as one that utilizes microwave heating, etc., may be used.

The heat exchanger unit 440 is connected with the controller 405. For example, the controller 405 heats the water to the temperature set by the operation part 500 by controlling the heat exchanger unit 440 according to an operation of the operation part 500 by the user.

A flow rate sensor 442 is located downstream of the heat exchanger unit 440. The flow rate sensor 442 detects the flow rate of the water discharged from the heat exchanger unit 440. In other words, the flow rate sensor 442 detects the flow rate of the water flowing through the pipe line 20*a*. The flow rate sensor 442 is connected to the controller 405. The flow rate sensor 442 inputs the detection result of the flow rate to the controller 405.

A vacuum breaker (VB) 452 is located downstream of the flow rate sensor 442. The vacuum breaker 452 includes, for example, a flow path where the water flows, an intake port for intaking air into the flow path, and a valve mechanism that opens and closes the intake port. For example, the valve mechanism blocks the intake port when water is flowing in the flow path, and intakes air into the flow path by opening the intake port when the flow of the water is stopped. In other words, the vacuum breaker 452 intakes air into the pipe line 20*a* when water does not flow in the water transfer part 20. The valve mechanism includes, for example, a float valve.

For example, by intaking air into the pipe line 20*a* as described above, the vacuum breaker 452 promotes the water drainage of the part of the pipe line 20*a* downstream of the vacuum breaker 452. For example, the vacuum breaker 452 promotes the water drainage of the nozzle 473. Thus, by draining the water inside the nozzle 473 and intaking air into the nozzle 473, for example, the vacuum breaker 452 prevents the wash water inside the nozzle 473, the liquid waste collected inside the bowl 801, etc., from undesirably flowing back toward the water supply source 10 (the fresh water) side.

An electrolytic cell unit 450 is located downstream of the vacuum breaker 452. The electrolytic cell unit 450 produces a liquid (functional water) including hypochlorous acid from tap water by electrolyzing the tap water flowing through the interior of the electrolytic cell unit 450. The electrolytic cell unit 450 is connected to the controller 405. The electrolytic cell unit 450 produces the functional water based on a control by the controller 405.

The functional water that is produced by the electrolytic cell unit 450 may be, for example, a solution including metal ions such as silver ions, copper ions, etc. Or, the functional water that is produced by the electrolytic cell unit 450 may be a solution including electrolytic chlorine, ozone, etc. Or, the functional water that is produced by the electrolytic cell unit 450 may be acidic water and alkaline water. A flow regulator 471 is located downstream of the electrolytic cell unit 450. The flow regulator 471 regulates the water force (the flow rate). The flow path switcher 472 is located downstream of the flow regulator 471. The flow path switcher 472 performs opening and closing and switching of the water supply to the nozzle 473 and/or a nozzle washer 478. The flow regulator 471 and the flow path switcher 472 may be included as one unit. The flow regulator 471 and the flow path switcher 472 are connected to the controller 405. The operations of the flow regulator 471 and the flow path switcher 472 are controlled by the controller 405.

The nozzle 473 and the nozzle washer 478 are located downstream of the flow path switcher 472. For example, the nozzle washer 478 washes the outer circumferential surface (the body) of the nozzle 473 by squirting water or functional water from a water discharger.

The nozzle 473 advances into the bowl 801 of the toilet 800 or retracts from the interior of the bowl 801 by receiving a drive force from a nozzle drive unit 476. The nozzle drive unit 476 advances and retracts the nozzle 473 between the storage position (i.e., the most retracted position) and the advanced position (i.e., the most advanced position). The nozzle drive unit 476 is described below.

A bottom wash channel 21, a gentle wash channel 22, and a bidet wash channel 23 that supply, to the nozzle 473, the water supplied from the water supply source 10 or the functional water produced by the electrolytic cell unit 450 via the water transfer part 20 also are located downstream of the flow path switcher 472. The bottom wash channel 21 connects the flow path switcher 472 and the bottom wash water discharge port 474*a*. The gentle wash channel 22 connects the flow path switcher 472 and the gentle wash water discharge port 474*b*. The bidet wash channel 23 connects the flow path switcher 472 and the bidet wash water discharge port 474*c*.

A surface wash channel 24 also is located downstream of the flow path switcher 472. The surface wash channel 24 guides, toward the water discharger of the nozzle washer 478, the water supplied from the water supply source 10 or the functional water produced by the electrolytic cell unit 450 via the water transfer part 20.

By controlling the flow path switcher 472, the controller 405 switches the opening and closing of the flow paths of the bottom wash channel 21, the gentle wash channel 22, the bidet wash channel 23, and the surface wash channel 24. Thus, the flow path switcher 472 switches between the state of communicating with the pipe line 20*a* and the state of not communicating with the pipe line 20*a* for each of the multiple water discharge ports of the bottom wash water discharge port 474*a*, the gentle wash water discharge port 474*b*, the bidet wash water discharge port 474*c*, the nozzle washer 478, etc.

Electrical power is supplied to the controller 405 from a power supply circuit 401; and the controller 405 controls the operations of the electromagnetic valve 431, the heat exchanger unit 440, the electrolytic cell unit 450, the flow regulator 471, the flow path switcher 472, the nozzle drive unit 476, etc., based on signals from the seating detection sensor 404, the flow rate sensor 442, the operation part 500, etc. Thereby, the controller 405 controls the operation of the nozzle 473.

Various mechanisms such as a "room heating unit", a "deodorizing unit", a "warm air drying function" that dries the "bottom" or the like of the user sitting on the toilet seat 200 by blowing warm air toward the "bottom" or the like, etc., also may be included as appropriate in the casing 400. However, in the invention, the sanitary washing functional units or the other additional functional units may not always be included.

The nozzle drive unit 476 will now be described in detail.

Figure 3:
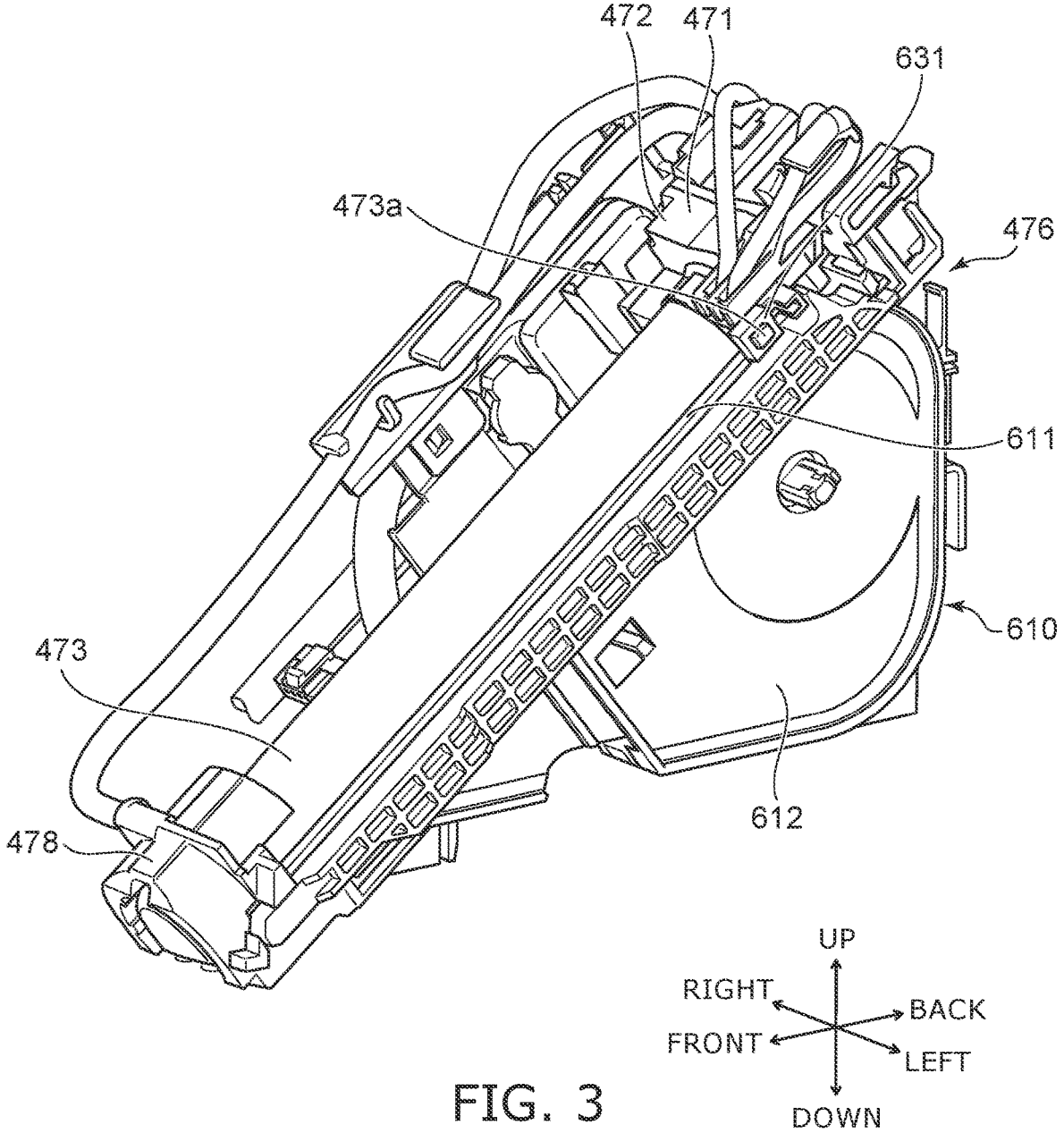
FIG. 3 is a perspective view illustrating the nozzle periphery according to the embodiment.

FIG. 3 is a perspective view illustrating the nozzle periphery according to the embodiment.

Figure 4:
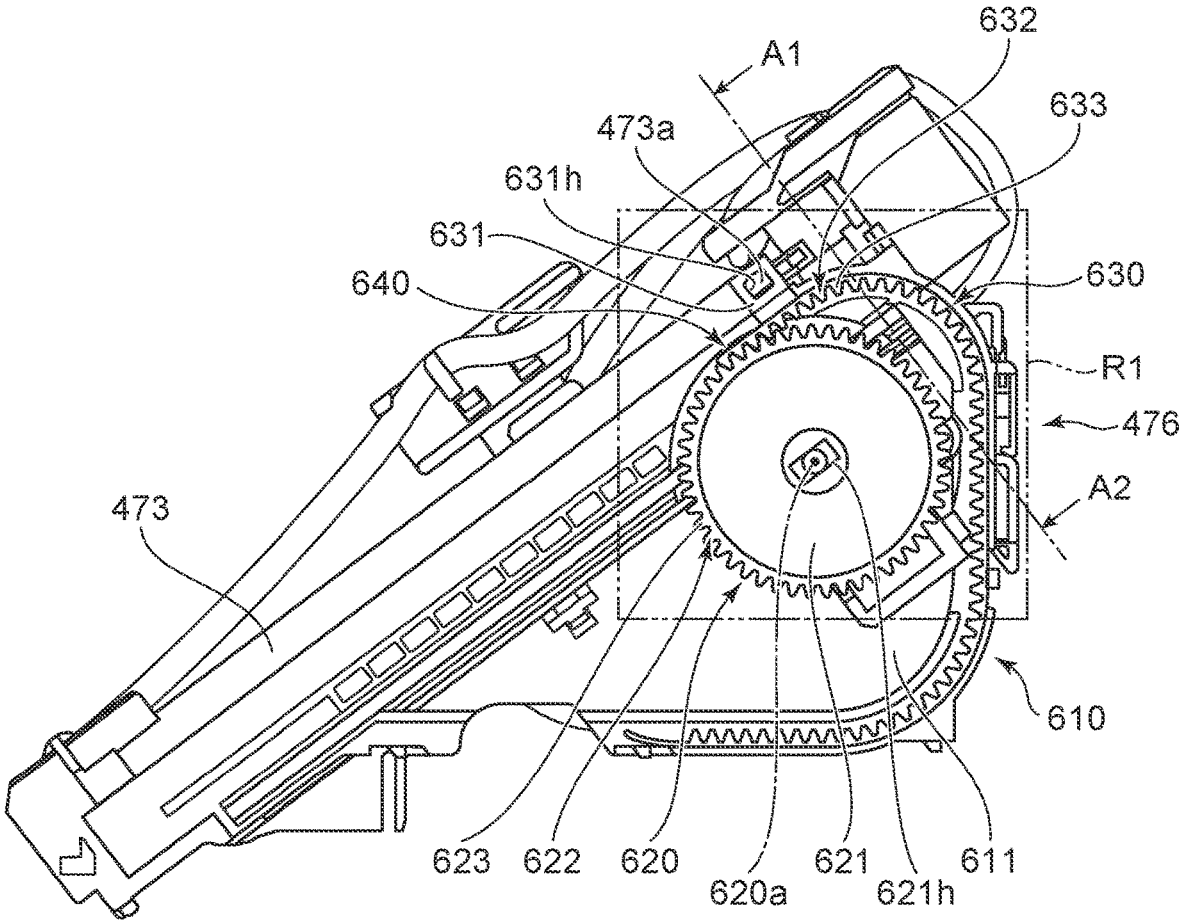
FIG. 4 is a side view illustrating the nozzle periphery according to the embodiment.
Figure 4:
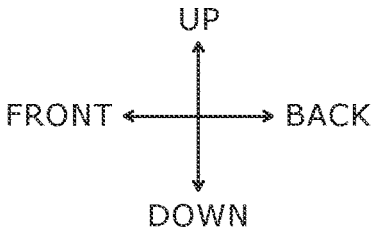
Figure 5:
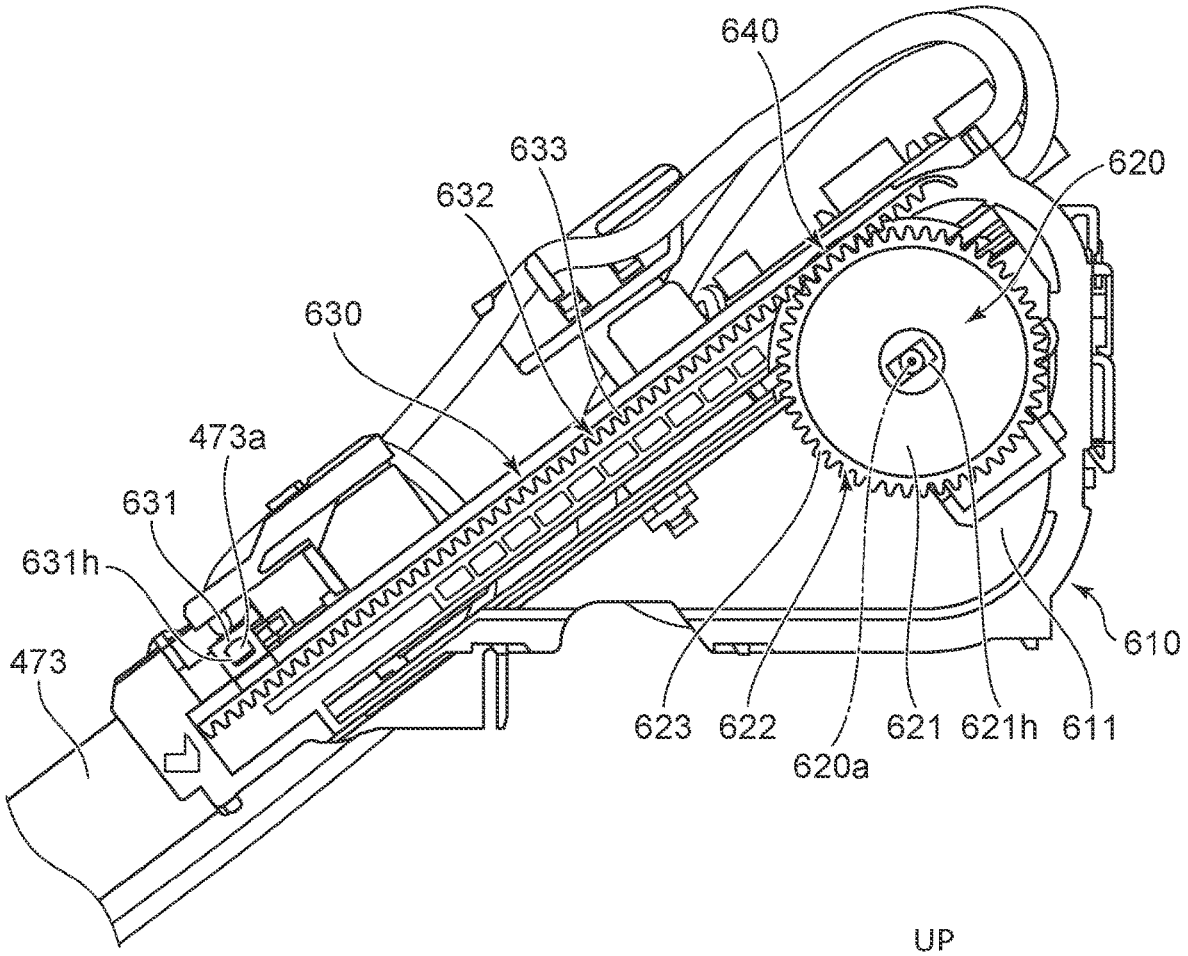
FIG. 5 is a side view illustrating the nozzle periphery according to the embodiment.
Figure 5:
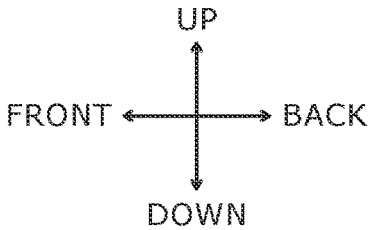

FIGS. 4 and 5 are side views illustrating the nozzle periphery according to the embodiment.

FIGS. 3 and 4 illustrate the nozzle 473 at the storage position. FIG. 5 illustrates the nozzle 473 at the advanced position.

As illustrated in FIGS. 3 to 5, the nozzle drive unit 476 includes a supporter 610, a gear 620, and a cable rack 630.

The supporter 610 is positioned below the nozzle 473 and supports the nozzle 473 from below. The supporter 610 includes a main part 611 that opens sideward and a cover part 612 that blocks the opening of the main part 611. FIGS. 4 and 5 illustrate the state in which the cover part 612 is detached.

The gear 620 and the cable rack 630 are stored inside the main part 611. The upper surface of the main part 611 slopes downward toward the front. The nozzle 473 advances frontward and downward and retracts backward and upward along the upper surface of the main part 611.

The gear 620 applies a drive force to advance and retract the nozzle 473. The gear 620 includes a connection part 621 and an engaging part 622. The connection part 621 includes a center axis 620*a* of the gear 620. The connection part 621 has a hole part 621*h* at a position overlapping the center axis 620*a*, and is connected with a motor (not illustrated) via the hole part 621*h*. For example, the motor is stored inside the main part 611. One or more other gears may be located between the motor and the connection part 621. For example, the other gears function as a speed reduction mechanism.

The engaging part 622 is located along the outer perimeter of the connection part 621. The engaging part 622 meshes with the cable rack 630 and includes multiple teeth 623 protruding toward the cable rack 630.

The cable rack 630 is connected with the nozzle 473 and meshes with the gear 620. The cable rack 630 transmits the drive force of the gear 620 to the nozzle 473. The cable rack 630 is a flexible rack gear. The cable rack 630 includes a nozzle connection part 631 and an engaging part 632.

The nozzle connection part 631 is connected with the nozzle 473. In the example, the nozzle 473 includes a protruding part 473*a* that protrudes sideward. The nozzle connection part 631 also includes a hole part 631*h* that extends sideward. The nozzle connection part 631 is connected with the nozzle 473 by inserting the protruding part 473*a* into the hole part 631*h*. That is, in the example, the nozzle connection part 631 is connected to the side surface of the nozzle 473.

The space below the nozzle 473 can be effectively used by connecting the nozzle connection part 631 to the side surface of the nozzle 473. Also, the distance between the motor and the nozzle 473 can be reduced. The height of the sanitary washing device 100 can be reduced thereby.

The engaging part 632 meshes with the gear 620 and includes multiple teeth 633 protruding toward the gear 620.

For example, the nozzle drive unit 476 advances and retracts the nozzle 473 connected to the cable rack 630 by using the motor to rotate the gear 620 to move the cable rack 630 meshed with the gear 620.

Figure 6:
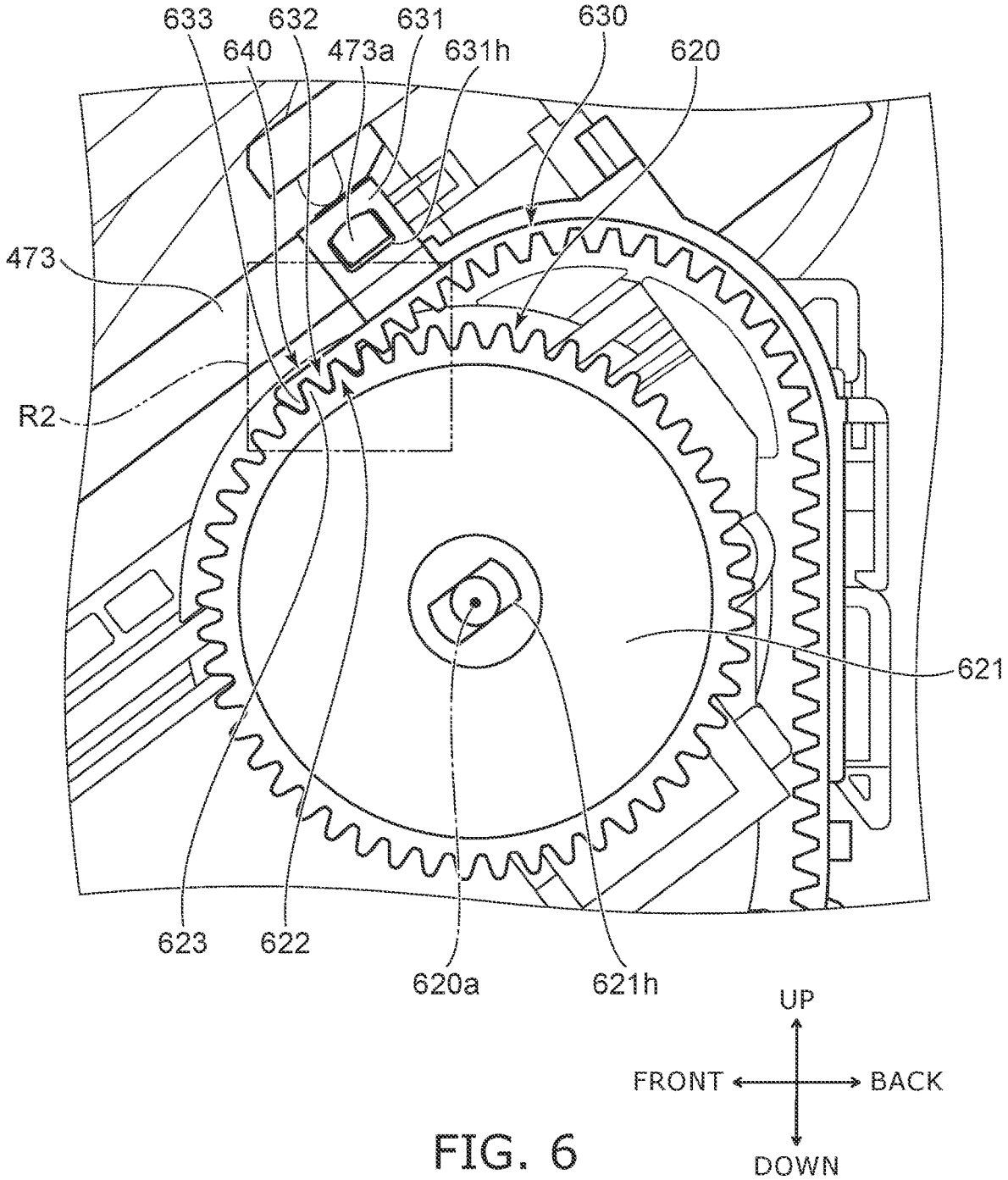
FIG. 6 is a side view illustrating a part of the nozzle drive unit according to the embodiment.

FIG. 6 is a side view illustrating a part of the nozzle drive unit according to the embodiment.

Figure 7:
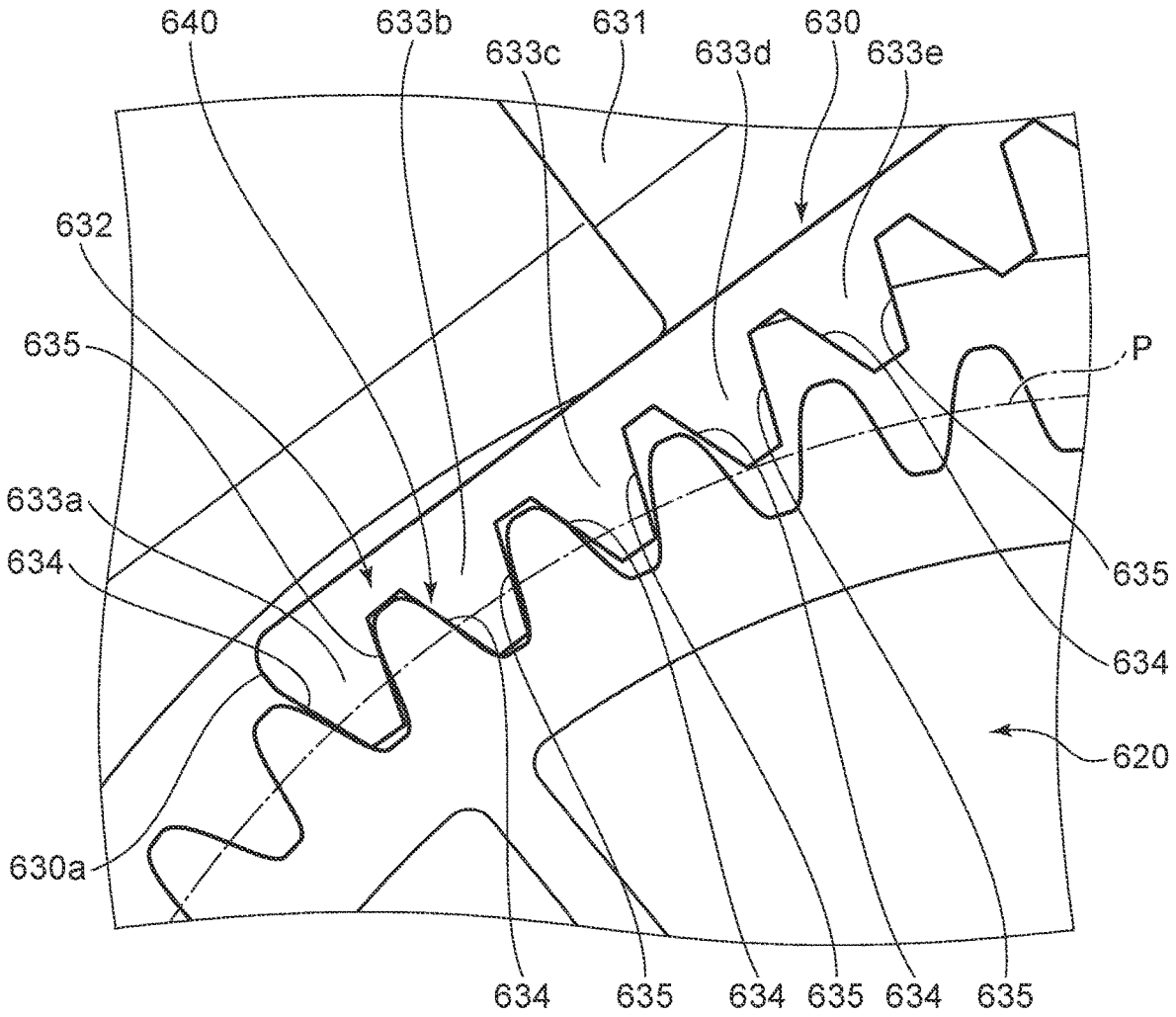
FIG. 7 is a side view illustrating the meshing part according to the embodiment.
Figure 7:
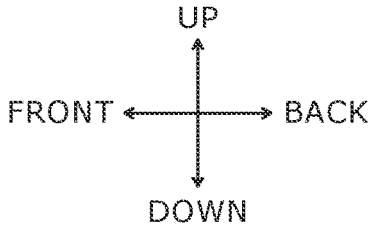

FIG. 7 is a side view illustrating the meshing part according to the embodiment.

FIG. 6 is an enlarged view of region R1 shown in FIG. 4.

FIG. 7 is an enlarged view of region R2 shown in FIG. 6.

FIGS. 6 and 7 each illustrate the nozzle 473 at the storage position.

As illustrated in FIG. 6, the gear 620 and the cable rack 630 mesh at a meshing part 640. The meshing part 640 is the part at which the engaging part 622 of the gear 620 and the engaging part 632 of the cable rack 630 engage.

For example, the meshing part 640 is positioned further frontward than the nozzle connection part 631 when the nozzle 473 is at the storage position. More specifically, for example, the back end of the meshing part 640 is positioned further frontward than the front end of the nozzle connection part 631 when the nozzle 473 is at the storage position. That is, for example, the meshing part 640 does not overlap the nozzle connection part 631 in the vertical direction when the nozzle 473 is at the storage position.

Because the meshing part 640 is positioned further frontward than the nozzle connection part 631 when the nozzle 473 is at the storage position, the length of the part of the cable rack 630 positioned further frontward than the meshing part 640 can be less than in the case where the meshing part 640 is positioned further backward than the nozzle connection part 631. The sliding resistance that is generated by the contact between the cable rack 630 and the supporter 610 when advancing and retracting the nozzle 473 can be reduced thereby, and the advance/retract operation of the nozzle 473 can be stabilized. Also, because the sliding resistance can be reduced, the motor that advances and retracts the nozzle 473 can be downsized. Also, the nozzle drive unit 476 can be downsized because the total length of the cable rack 630 is reduced.

As illustrated in FIG. 7, for example, the meshing part 640 is positioned further backward than a front end 630*a* of the cable rack 630 when the nozzle 473 is at the storage position. For example, the meshing part 640 is positioned within four teeth from the front end 630*a* of the cable rack 630 when the nozzle 473 is at the storage position.

More specifically, for example, the engaging part 632 of the cable rack 630 includes a first tooth 633*a*, a second tooth 633*b*, a third tooth 633*c*, a fourth tooth 633*d*, and a fifth tooth 633*e* arranged in this order from the front end 630*a* side. The first to fifth teeth 633*a* to 633*e* each include a front surface 634 and a back surface 635. The front surface 634 of the first tooth 633*a* is included in the front end 630*a* of the cable rack 630. For example, the meshing part 640 is positioned further backward than the front surface 634 of the first tooth 633*a* when the nozzle 473 is at the storage position. Also, for example, the meshing part 640 is positioned further backward than the front surface 634 of the first tooth 633*a* and further frontward than the front surface 634 of the fifth tooth 633*e* when the nozzle 473 is at the storage position. In other words, for example, the meshing part 640 is formed of at least one of the back surface 635 of the first tooth 633*a*, the front surface 634 of the second tooth 633*b*, the back surface 635 of the second tooth 633*b*, the front surface 634 of the third tooth 633*c*, the back surface 635 of the third tooth 633*c*, the front surface 634 of the fourth tooth 633*d*, or the back surface 635 of the fourth tooth 633*d* when the nozzle 473 is at the storage position.

For example, the meshing part 640 is the part at which the cable rack 630 and the gear 620 abut along a pitch circumference P of the gear 620. In the example, the meshing part 640 is the part at which the gear 620 and the front surface 634 of the second tooth 633*b* abut when the nozzle 473 is at the storage position.

The gear 620 and the cable rack 630 can be more reliably meshed because the meshing part 640 is positioned further backward than the front end 630*a* of the cable rack 630 when the nozzle 473 is at the storage position.

Because the meshing part 640 is positioned within four teeth from the front end 630*a* of the cable rack 630 when the nozzle 473 is at the storage position, the gear 620 and the cable rack 630 can be more reliably meshed, and the exposure of the cable rack 630 outside the casing 400 can be suppressed even when the nozzle 473 is at the advanced position.

As illustrated in FIG. 6, for example, the meshing part 640 is located higher than the center axis 620*a* of the gear 620. That is, for example, the center axis 620*a* of the gear 620 is positioned lower than the meshing part 640.

Because the center axis 620*a* of the gear 620 is positioned lower than the meshing part 640, the height of the nozzle drive unit 476 can be less than in the case where the center axis 620*a* of the gear 620 is positioned higher than the meshing part 640.

In the example, the meshing part 640 is located further frontward than the center axis 620*a* of the gear 620. That is, in the example, the center axis 620*a* of the gear 620 is positioned further backward than the meshing part 640. The meshing part 640 may be located further backward than the center axis 620*a* of the gear 620, or may be located at the same position in the longitudinal direction as the center axis 620*a* of the gear 620.

Figure 8:
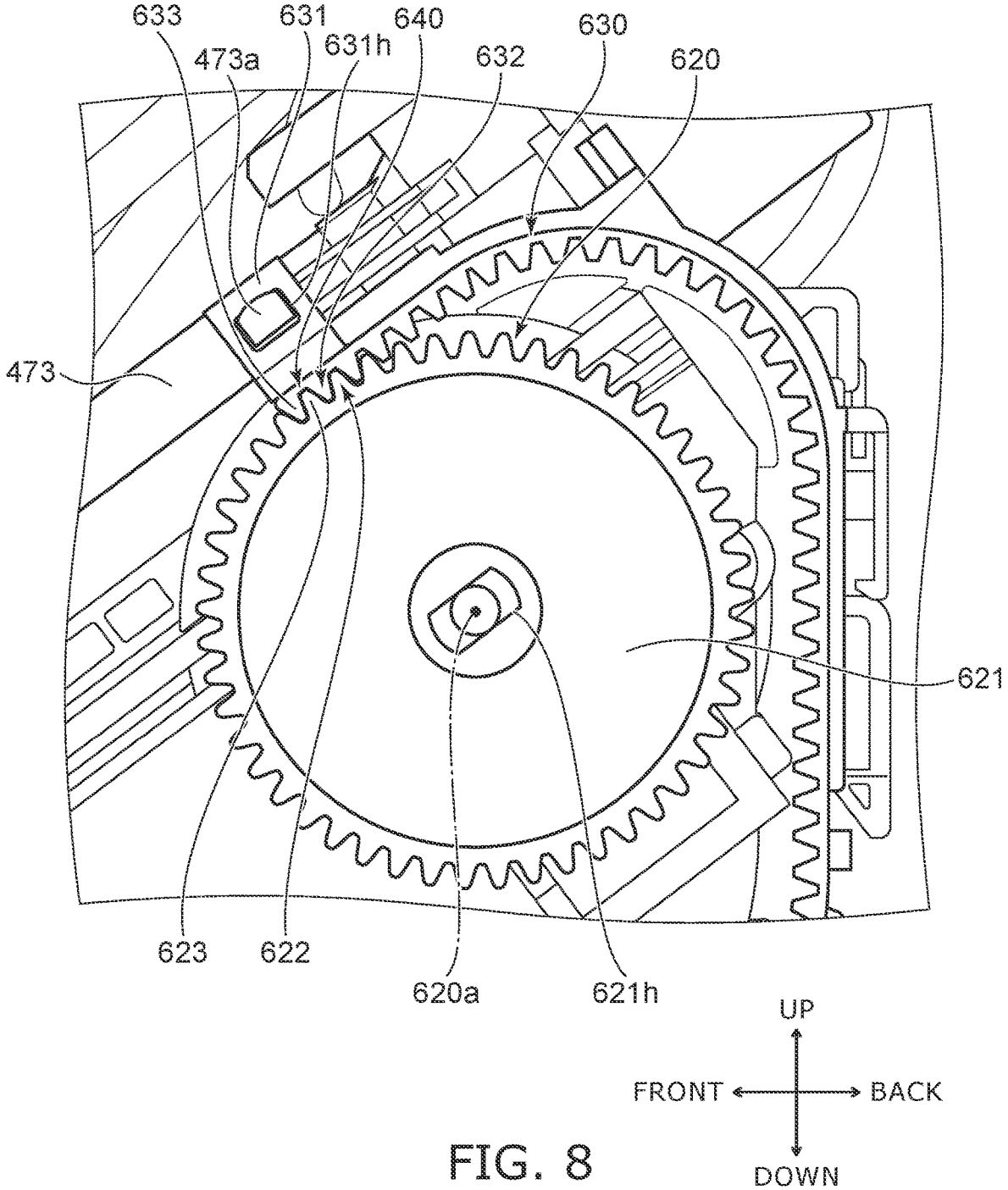
FIG. 8 is a side view illustrating a part of a nozzle drive unit according to a modification of the embodiment.

FIG. 8 is a side view illustrating a part of a nozzle drive unit according to a modification of the embodiment.

In the example as illustrated in FIG. 8, the meshing part 640 is positioned at the same position in the longitudinal direction as the nozzle connection part 631 when the nozzle 473 is at the storage position. That is, in the example, the meshing part 640 overlaps the nozzle connection part 631 in the vertical direction when the nozzle 473 is at the storage position.

Because the meshing part 640 is positioned at the same position in the longitudinal direction as the nozzle connection part 631 when the nozzle 473 is at the storage position, the length of the part of the cable rack 630 positioned further frontward than the meshing part 640 can be less than in the case where the meshing part 640 is positioned further backward than the nozzle connection part 631. The sliding resistance that is generated by the contact between the cable rack 630 and the supporter 610 when advancing and retracting the nozzle 473 can be reduced thereby, and the advance/retract operation of the nozzle 473 can be stabilized. Also, the motor that advances and retracts the nozzle 473 can be downsized because the sliding resistance can be reduced. The nozzle drive unit 476 can be downsized because the total length of the cable rack 630 is reduced.

Figure 9:
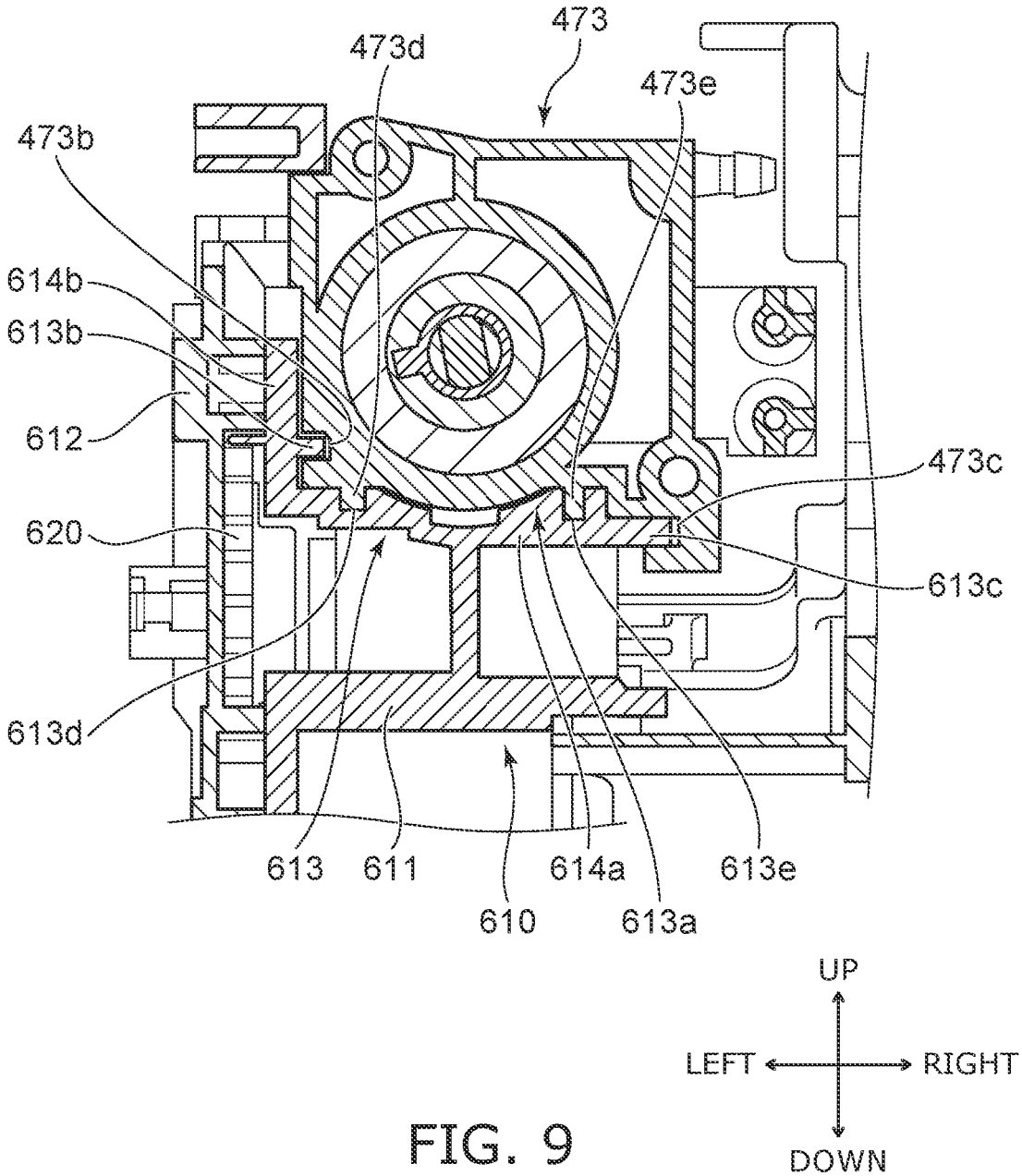
FIG. 9 is a cross-sectional view illustrating the nozzle periphery according to the embodiment.

FIG. 9 is a cross-sectional view illustrating the nozzle periphery according to the embodiment.

FIG. 9 is a cross-sectional view along line A1-A2 shown in FIG. 4

As illustrated in FIG. 9, the main part 611 of the supporter 610 includes a rail 613 for sliding the nozzle 473.

The rail 613 includes a base 613*a*, a first protrusion 613*b*, a second protrusion 613*c*, a first recess 613*d*, and a second recess 613*e*. The base 613*a* includes a lower part 614*a* positioned below the nozzle 473, and a side part 614*b* positioned at the side of the nozzle 473.

The first protrusion 613*b* protrudes rightward from the side part 614*b* of the base 613*a*. The second protrusion 613*c* protrudes rightward from the lower part 614*a* of the base 613*a*. The first recess 613*d* and the second recess 613*e* are provided in the lower part 614*a* of the base 613*a* and are recessed downward. The first recess 613*d* and the second recess 613*e* are provided between the first protrusion 613*b* and the second protrusion 613*c*. The first protrusion 613*b* and the second protrusion 613*c* are located at laterally asymmetric positions.

The nozzle 473 includes a first holding part 473*b*, a second holding part 473*c*, a first held part 473*d*, and a second held part 473*e*. The first holding part 473*b* is recessed rightward and slidably holds the first protrusion 613*b*. The second holding part 473*c* is recessed rightward and slidably holds the second protrusion 613*c*. The first held part 473*d* protrudes downward and is slidably held by the first recess 613*d*. The second held part 473*e* protrudes downward and is slidably held by the second recess 613*e*. The first held part 473*d* and the second held part 473*e* are located between the first holding part 473*b* and the second holding part 473*c*. The first holding part 473*b* and the second holding part 473*c* are located at laterally asymmetric positions.

Because the first holding part 473*b* and the second holding part 473*c* (the first protrusion 613*b* and the second protrusion 613*c*) are located at laterally asymmetric positions, the distance between the first holding part 473*b* and the second holding part 473*c* can be increased. Thereby, looseness when sliding the nozzle 473 can be suppressed, noise when sliding can be suppressed, and the stability of the operation can be improved.

Figure 10:
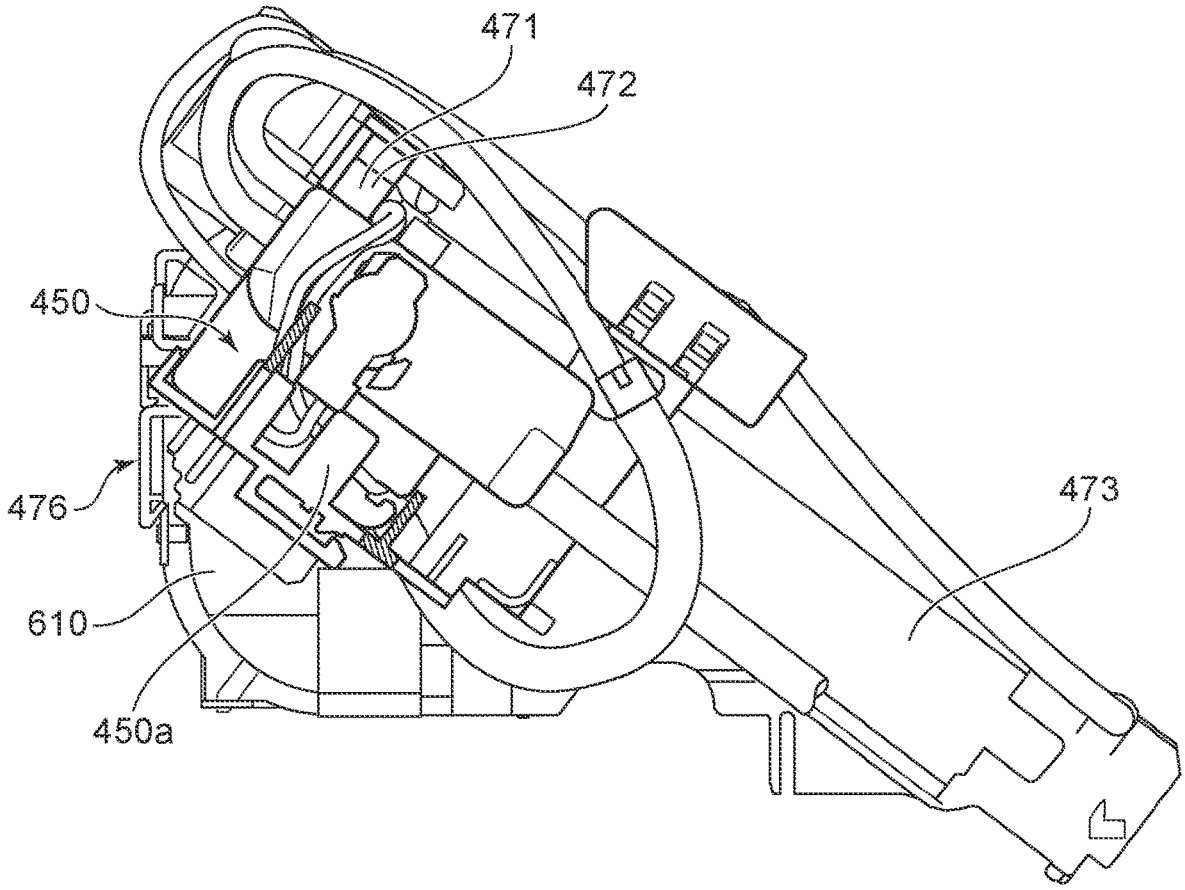
FIG. 10 is a side view illustrating the nozzle periphery according to the embodiment.
Figure 10:
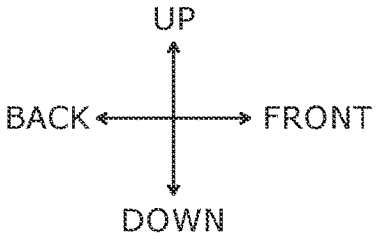

FIG. 10 is a side view illustrating the nozzle periphery according to the embodiment.

As illustrated in FIG. 10, the electrolytic cell unit 450 is mounted to the supporter 610 of the nozzle drive unit 476 via a mounting member 450*a* at the side of the nozzle drive unit 476. As described above, the electrolytic cell unit 450 is connected to the nozzle 473 via the flow regulator 471 and the flow path switcher 472 without the vacuum breaker 452 interposed.

By mounting the electrolytic cell unit 450 to the nozzle drive unit 476, the electrolytic cell unit 450 can be located at the vicinity of the nozzle 473. The volume of the path from the electrolytic cell unit 450 to the nozzle 473 is reduced thereby, so that the functional water produced by the electrolytic cell unit 450 can reach the nozzle 473 in a shorter period of time. Accordingly, the reduction of the effect of the functional water until reaching the nozzle 473 from the electrolytic cell unit 450 can be suppressed. By mounting the electrolytic cell unit 450 to the nozzle drive unit 476, the space inside the casing 400 can be used more effectively than when the electrolytic cell unit 450 and the nozzle drive unit 476 are separately located. The sanitary washing device 100 can be downsized thereby, and the design quality can be improved.

Figure 11A:
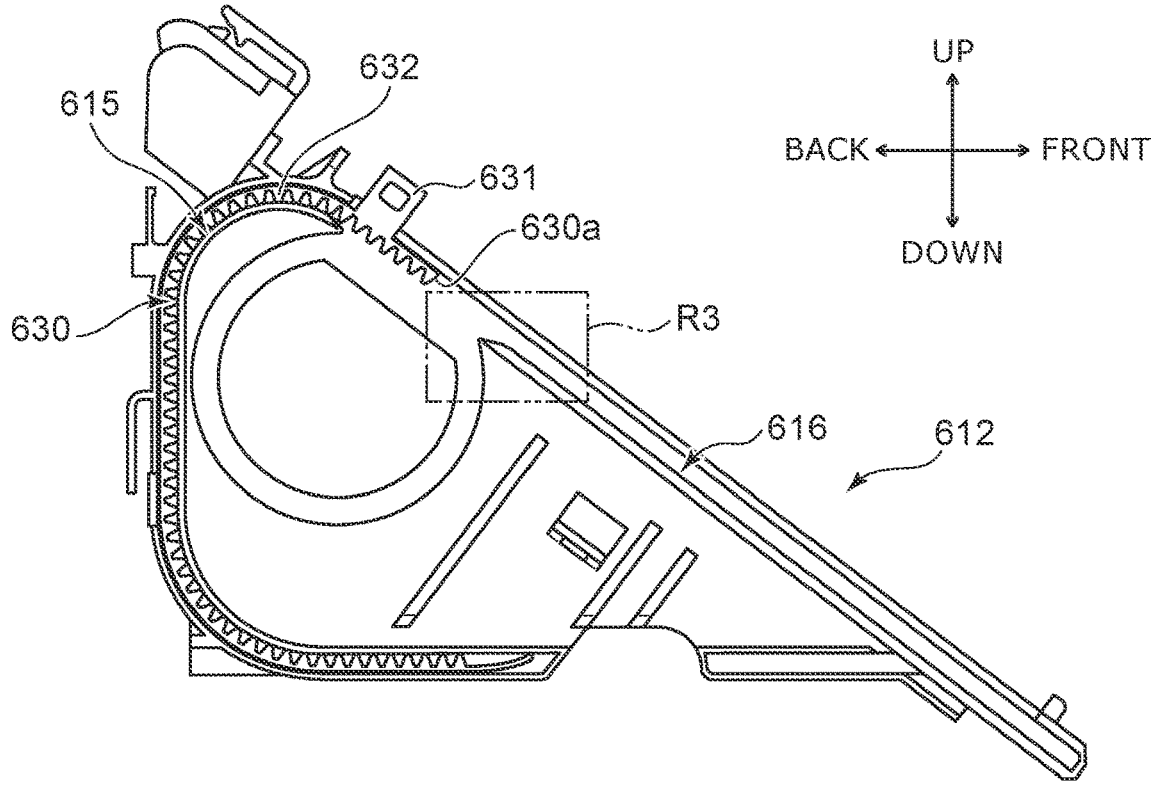
FIGS. 11A and 11B are side views illustrating a part of the nozzle drive unit according to the embodiment.
Figure 11B:
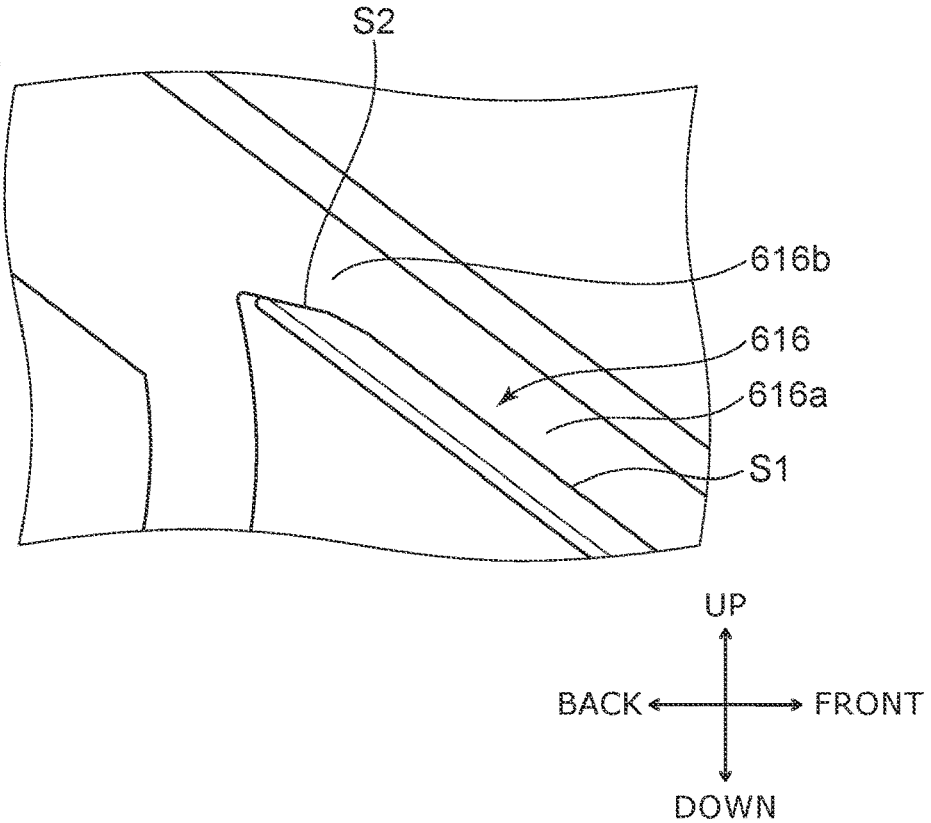

FIGS. 11A and 11B are side views illustrating a part of the nozzle drive unit according to the embodiment.

FIG. 11B is an enlarged view of region R3 shown in FIG. 11A.

FIGS. 11A and 11B illustrate the cable rack 630 and the cover part 612 of the supporter 610.

As illustrated in FIGS. 11A and 11B, a first rack storage part 615 and a second rack storage part 616 that store the cable rack 630 are provided in the cover part 612.

The first rack storage part 615 can store the cable rack 630 when the nozzle 473 is at the storage position. The first rack storage part 615 is a groove provided in the side surface of the cover part 612. In the example, when the nozzle 473 is at the storage position, the first rack storage part 615 extends backward from the position of the nozzle connection part 631, curves downward, and then curves frontward.

The second rack storage part 616 can store the cable rack 630 when the nozzle 473 is at the advanced position. The second rack storage part 616 is a groove provided in the side surface of the cover part 612. In the example, the second rack storage part 616 extends in a straight line frontward and downward from a position further frontward than the front end 630*a* of the cable rack 630 when the nozzle 473 is at the storage position.

The cable rack 630 meshes with the gear 620 between the first rack storage part 615 and the second rack storage part 616. That is, the first rack storage part 615 stores the cable rack 630 before meshing with the gear 620; and the second rack storage part 616 stores the cable rack 630 after meshing with the gear 620.

As illustrated in FIG. 11B, the second rack storage part 616 includes an extension part 616*a* that extends in a straight line, and a guide part 616*b* that is located at the back end of the extension part 616*a*. The guide part 616*b* is disposed so that the opening width in the vertical direction gradually increases backward from the back end of the extension part 616*a*. More specifically, a surface S2 that is included in the lower end of the guide part 616*b* has a slope with respect to a surface S1 included in the lower end of the extension part 616*a*. The angle between the surface S2 and the horizontal plane is less than the angle between the surface S1 and the horizontal plane.

As described above, if the meshing part 640 is positioned further frontward than the nozzle connection part 631 when the nozzle 473 is at the storage position, the front end 630*a* vicinity of the cable rack 630 easily warps downward. By providing the guide part 616*b* in the second rack storage part 616, the front end 630*a* of the cable rack 630 can be guided to the extension part 616*a* even when the front end 630*a* vicinity of the cable rack 630 warps downward. Sliding defects can be suppressed thereby.

As described above, the first rack storage part 615 is curved. The nozzle drive unit 476 can be downsized because the first rack storage part 615 is curved. On the other hand, when the first rack storage part 615 is curved, the sliding resistance between the cable rack 630 and the first rack storage part 615 easily increases at the curved part.

Conversely, because the meshing part 640 is positioned at the same position in the longitudinal direction as the nozzle connection part 631 or further frontward than the nozzle connection part 631 when the nozzle 473 is at the storage position, the length of the cable rack 630 that passes through the curved part of the first rack storage part 615 can be less than in the case where the meshing part 640 is positioned further backward than the nozzle connection part 631. The sliding resistance when advancing and retracting the nozzle 473 can be reduced thereby.

Thus, according to embodiments, a sanitary washing device is provided in which the sliding resistance when advancing and retracting the nozzle can be reduced.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. For example, the shape, the dimension, the material, the disposition, the installation feature or the like of the components included in the sanitary washing device are not limited to the illustration and can be appropriately modified.

The components included in the embodiments described above can be combined within the extent of technical feasibility, and any combined components also are included in the scope of the invention to the extent that the feature of the invention is included.

What is claimed is:

1. A sanitary washing device, comprising:

a casing;

a nozzle washing a human body private part; and a nozzle drive unit advancing and retracting the nozzle between a storage position and an advanced position, the nozzle being stored in the casing at the storage position, the nozzle being advanced from the casing at the advanced position, the nozzle drive unit including a supporter supporting the nozzle, the supporter including a rail allowing the nozzle to slide, a gear applying a drive force to advance and retract the nozzle, and a cable rack connected with the nozzle and meshing with the gear, the cable rack including a nozzle connection part connected with the nozzle, the gear and the cable rack meshing at a meshing part, the meshing part being positioned at a same position in a longitudinal direction as the nozzle connection part or further frontward than the nozzle connection part when the nozzle is at the storage position.

2. The device according to claim 1, wherein the meshing part is positioned further backward than a front end of the cable rack when the nozzle is at the storage position.

3. The device according to claim 2, wherein the meshing part is positioned within four teeth from the front end of the cable rack when the nozzle is at the storage position.

4. The device according to claim 1, wherein a center axis of the gear is positioned lower than the meshing part.

5. The device according to claim 1, wherein the nozzle connection part is connected to a side surface of the nozzle.

* * * * *